US011170796B2

(12) United States Patent
Yamamoto et al.

(10) Patent No.: US 11,170,796 B2
(45) Date of Patent: Nov. 9, 2021

(54) MULTIPLE METADATA PART-BASED ENCODING APPARATUS, ENCODING METHOD, DECODING APPARATUS, DECODING METHOD, AND PROGRAM

(71) Applicant: Sony Corporation, Tokyo (JP)

(72) Inventors: Yuki Yamamoto, Tokyo (JP); Toru Chinen, Kanagawa (JP); Minoru Tsuji, Chiba (JP)

(73) Assignee: Sony Corporation, Tokyo (JP)

( * ) Notice: Subject to any disclaimer, the term of this patent is extended or adjusted under 35 U.S.C. 154(b) by 88 days.

(21) Appl. No.: 16/447,693

(22) Filed: Jun. 20, 2019

(65) Prior Publication Data

US 2019/0304479 A1 Oct. 3, 2019

Related U.S. Application Data

(63) Continuation of application No. 15/735,630, filed as application No. PCT/JP2016/066574 on Jun. 3, 2016, now abandoned.

(30) Foreign Application Priority Data

Jun. 19, 2015 (JP) ..... 2015-123589
Oct. 2, 2015 (JP) ..... 2015-196494

(51) Int. Cl.
*G10L 19/16* (2013.01)
*G10L 19/008* (2013.01)
(Continued)

(52) U.S. Cl.
CPC ..... *G10L 19/167* (2013.01); *G10L 19/008* (2013.01); *H04S 3/008* (2013.01);
(Continued)

(58) Field of Classification Search
CPC ..... G10L 19/008; G10L 19/167; H04S 3/008
See application file for complete search history.

(56) References Cited

U.S. PATENT DOCUMENTS 8,682,679 B2 3/2014 Breebaart
8,804,971 B1 8/2014 Williams et al.
(Continued)

FOREIGN PATENT DOCUMENTS

JP 2014-522155 A 8/2014
WO WO 2013/006338 A2 1/2013
(Continued)

OTHER PUBLICATIONS

U.S. Appl. No. 15/735,630, filed Dec. 12, 2017, Yamamoto et al.
(Continued)

*Primary Examiner* — Shaun Roberts
(74) *Attorney, Agent, or Firm* — Wolf, Greenfield & Sacks, P.C.

(57) ABSTRACT

The present technology relates to an encoding apparatus, an encoding method, a decoding apparatus, a decoding method, and a program for obtaining sound of higher quality. An audio signal decoding section decodes encoded audio data to acquire an audio signal of each object. A metadata decoding section decodes encoded metadata to acquire a plurality of metadata about each object in each frame of the audio signal. A gain calculating section calculates VBAP gains of each object in the audio signal for each speaker based on the metadata. An audio signal generating section generates an audio signal to be fed to each speaker by having the audio signal of each object multiplied by the corresponding VBAP gain and by adding up the multiplied audio signals. The present technology may be applied to decoding apparatuses.

4 Claims, 6 Drawing Sheets

(51) Int. Cl.
*H04S 3/00* (2006.01)
*H04S 7/00* (2006.01)

(52) U.S. Cl.
CPC ..... *H04S 7/30* (2013.01); *H04S 2400/11* (2013.01); *H04S 2420/03* (2013.01)

(56) References Cited

U.S. PATENT DOCUMENTS

| | | | |
|---|---|---|---|
| 9,826,328 | B2 | 11/2017 | Mehta et al. |
| 2013/0216070 | A1 | 8/2013 | Keiler et al. |
| 2014/0013368 | A1 | 1/2014 | Barrett |
| 2014/0016802 | A1 | 1/2014 | Sen |
| 2014/0023197 | A1 | 1/2014 | Xiang et al. |
| 2014/0133683 | A1 | 5/2014 | Robinson et al. |
| 2014/0297291 | A1 | 10/2014 | Baumgarte |
| 2018/0077511 | A1 | 3/2018 | Mehta et al. |
| 2018/0315436 | A1 | 11/2018 | Yamamoto et al. |

FOREIGN PATENT DOCUMENTS

| | | | |
|---|---|---|---|
| WO | WO 2014/036121 | A1 | 3/2014 |
| WO | WO 2014/087277 | A1 | 6/2014 |
| WO | WO 2014/187991 | A1 | 11/2014 |

OTHER PUBLICATIONS

Korean Office Action dated Mar. 18, 2020 in connection with Korean Application No. 10-2018-7027071 and English translation thereof.

International Search Report and Written Opinion and English translation thereof dated Jul. 12, 2016 in connection with International Application No. PCT/JP2016/066574.

International Preliminary Report on Patentability and English translation thereof dated Dec. 28, 2017 in connection with International Application No. PCT/JP2016/066574.

Korean Office Action and English translation thereof dated Mar. 19, 2018 in connection with Korean Application No. 10-2017-7035762.

Korean Office Action dated Jul. 20, 2018 in connection with Korean Application No. 10-2017-7035762 and English translation thereof.

Korean Office Action dated Oct. 10, 2018 in connection with Korean Application No. 10-2017-7035762, and English translation thereof.

Extended European Search Report dated Jan. 18, 2019 in connection with European Application No. 16811469.2.

Bae Chon et al., Proposed artistic trajectory for object rendering: Merit, example, and market needs. Motion Picture Expert Group ISO/IEC JTC1/SC29/WG11 MPEG2012/M34250. Jul. 2014, Sapporo, Japan. 32 pages.

Herre et al., MPEG-H Audio—The New Standard for Universal Spatial / 3D Audio Coding, Engineering Society, Jan. 5, 2015, 12 pages.

No Author Listed, Information technology—High efficiency coding and media delivery in heterogeneous environments—Part 3: 3D Audio, Draft International Standard ISO/IEC DIS 23008-3, ISO/IEC JTC 1/SC 29/WG 11, Jul. 25, 2014, 433 pages.

Pulkki, Virtual Sound Source Positioning Using Vector Base Amplitude Panning, Journal of AES, 1997, vol. 45, No. 6, pp. 456-466.

Chinese Office Action dated Aug. 14, 2019 in connection with Chinese Application No. 201680034330.X and English translation thereof.

Korean Office Action dated Sep. 11, 2019 in connection with Korean Application No. 10-2018-7027071 and English translation thereof.

Japanese Office Action dated Jul. 14, 2020 in connection with Japanese Application No. 2017-524823 and English translation thereof.

MULTIPLE METADATA PART-BASED ENCODING APPARATUS, ENCODING METHOD, DECODING APPARATUS, DECODING METHOD, AND PROGRAM

CROSS REFERENCE TO RELATED APPLICATIONS

This application is a continuation of and claims the benefit under 35 U.S.C. § 120 of U.S. patent application Ser. No. 15/735,630, titled "ENCODING APPARATUS, ENCODING METHOD, DECODING APPARATUS, DECODING METHOD, AND PROGRAM," filed on Dec. 12, 2017, which claims the benefit under 35 U.S.C. § 371 as a U.S. National Stage Entry of International Application No. PCT/JP2016/066574, filed Jun. 3, 2016, entitled "ENCODING APPARATUS, ENCODING METHOD, DECODING APPARATUS, DECODING METHOD, AND PROGRAM", which claims priority under 35 U.S.C. § 119(a)-(d) or 35 U.S.C. § 365(b) to Japanese application number 2015-196494, filed Oct. 2, 2015 and Japanese application number 2015-123589, filed Jun. 19, 2015, the entire contents of which are incorporated herein by reference in their entireties.

TECHNICAL FIELD

The present technology relates to an encoding apparatus, an encoding method, a decoding apparatus, a decoding method, and a program. More particularly, the present technology relates to an encoding apparatus, an encoding method, a decoding apparatus, a decoding method, and a program for acquiring sound of higher quality.

BACKGROUND ART

In the past, the moving picture experts group-high quality (MPEG-H), three-dimensional (3D) Audio standards for compressing (encoding) the audio signal of an audio object and metadata such as position information about that audio object has been known (e.g., see NPL 1).

According to the above-cited techniques, the audio signal of the audio object and its metadata are encoded per frame and transmitted. In this case, a maximum of one metadata is encoded for each frame of the audio signal of the audio object and transmitted. That is, some frames may have no metadata.

Also, the encoded audio signal and metadata are decoded by a decoding apparatus. Rendering is then performed on the basis of the audio signal and metadata obtained by decoding.

That is, the decoding apparatus first decodes the audio signal and metadata. When decoded, the audio signal turns into pulse code modulation (PCM) sampled data per sample in each frame. That is, PCM data is obtained as the audio signal.

On the other hand, the metadata when decoded turns into metadata about a representative sample in the frame. Specifically, what is obtained here is the metadata about the last sample in the frame.

With the audio signal and metadata thus obtained, a renderer in the decoding apparatus calculates a vector base amplitude panning (VBAP) gain by VBAP based on the position information constituted by the metadata about the representative sample in each frame, in such a manner that a sound image of the audio object is localized at the position designated by the position information. The VBAP gain is calculated for each of the speakers configured on the reproducing side.

However, it is to be noted that the metadata about the audio object is the metadata about the representative sample in each frame, i.e., the metadata about the last sample in the frame as described above. That means the VBAP gain calculated by the renderer is the gain of the last sample in the frame. The VBAP gain of any other sample in the frame is not obtained. It follows that to reproduce the sound of the audio object requires also calculating the VBAP gains of the samples other than the representative samples of the audio signal.

The renderer thus calculates the VBAP gain of each sample through an interpolation process. Specifically, for each speaker, linear interpolation is performed to calculate the VBAP gains of the samples in the current frame between the last sample in the current frame and the last sample in the immediately preceding frame using the VBAP gains of the two last samples.

In this manner, the VBAP gain of each sample by which to multiply the audio signal of the audio object is obtained for each speaker. This permits reproduction of sound of the audio object.

That is, the decoding apparatus multiplies the audio signal of the audio object by the VBAP gain calculated for each speaker before supplying the audio signal to the speakers for sound reproduction.

CITATION LIST

Non Patent Literature

[NPL 1]
ISO/IEC JTC1/SC29/WG11 N14747, August 2014, Sapporo, Japan, "Text of ISO/IEC 23008-3/DIS, 3D Audio"

SUMMARY

Technical Problem

The above-cited techniques, however, have difficulty in acquiring sound of sufficiently high quality.

For example, VBAP involves normalization such that the sum of squares of the calculated VBAP gains for each of the configured speakers becomes 1. Such normalization allows the sound image to be localized on the surface of a sphere with a radius of 1 centering on a predetermined reference point in a reproduction space, such as the head position of a virtual user viewing or listening to content such as pieces of music or videos with sound.

However, because the VBAP gains of the samples other than those of the representative samples in the frames are calculated by interpolation process, the sum of squares of the VBAP gains of these samples for each speaker does not become 1. Given the samples whose VBAP gains are calculated by interpolation process, the position of the sound image can be shifted in a normal, a vertical or a horizontal direction over the surface of the above-mentioned sphere as viewed from the virtual user at the time of sound reproduction. As a result, the sound image position of the audio object can be destabilized in a single-frame period during sound reproduction. This can worsen the sense of localization and lead to lower quality of sound.

In particular, the larger the number of samples making up each frame, the longer the time segment between the last sample position in the current frame and the last sample position in the immediately preceding frame can become. This can lead to a larger difference between the value 1 and the sum of squares of the VBAP gains for the configured speakers calculated by interpolation process, resulting in deteriorating quality of sound.

Also, when the VBAP gains of the samples other than those of the representative samples are calculated by interpolation process, the difference between the VBAP gain of the last sample in the current frame and the VBAP gain of the last sample in the immediately preceding frame can become larger the higher the speed of the audio object. If that happens, it is more difficult to accurately render the movement of the audio object, resulting in lower quality of sound.

Furthermore, in actual content such as sports or movies, scenes can switch discontinuously. In a portion where scenes are switched in this manner, the audio object is moved discontinuously. However, if the VBAP gains are calculated by interpolation process as described above, the audio object appears to move continuously about sound in the time segment between the samples whose VBAP gains are calculated by interpolation process, i.e., between the last sample in the current frame and the last sample in the immediately preceding frame. This makes it impossible to express the discontinuous movement of the audio object through rendering, which can worsen the quality of sound.

The present technology has been devised in view of the above circumstances. An object of the technology is therefore to acquire sound of higher quality.

Solution to Problem

According to a first aspect of the present technology, there is provided a decoding apparatus including an acquisition section configured to acquire both encoded audio data obtained by encoding an audio signal of an audio object in a frame of a predetermined time segment and a plurality of metadata for the frame, a decoding section configured to decode the encoded audio data, and a rendering section configured to perform rendering based on the audio signal obtained by the decoding and on the metadata.

The metadata may include position information indicating a position of the audio object.

Each of the plurality of metadata may be metadata for multiple samples in the frame of the audio signal.

Each of the plurality of metadata may be metadata for multiple samples counted by dividing the number of the samples making up the frame by the number of the metadata.

Each of the plurality of metadata may be metadata for multiple samples indicated by each of multiple sample indexes.

Each of the plurality of metadata may be metadata for multiple samples of a predetermined sample count in the frame.

The metadata may include metadata for use in performing an interpolation process on gains of samples in the audio signal, the gains being calculated on the basis of the metadata.

Also according to the first aspect of the present technology, there is provided a decoding method or a program including the steps of acquiring both encoded audio data obtained by encoding an audio signal of an audio object in a frame of a predetermined time segment and a plurality of metadata for the frame, decoding the encoded audio data, and performing rendering based on the audio signal obtained by the decoding and on the metadata.

Thus according to the first aspect of the present technology, both encoded audio data obtained by encoding an audio signal of an audio object in a frame of a predetermined time segment and a plurality of metadata for the frame are acquired, the encoded audio data is decoded, and rendering is performed on the basis of the audio signal obtained by the decoding and the metadata.

According to a second aspect of the present technology, there is provided an encoding apparatus including an encoding section configured to encode an audio signal of an audio object in a frame of a predetermined time segment, and a generation section configured to generate a bit stream including encoded audio data obtained by the encoding and a plurality of metadata for the frame.

The metadata may include position information indicating a position of the audio object.

Each of the plurality of metadata may be metadata for multiple samples in the frame of the audio signal.

Each of the plurality of metadata may be metadata for multiple samples counted by dividing the number of the samples making up the frame by the number of the metadata.

Each of the plurality of metadata may be metadata for multiple samples indicated by each of multiple sample indexes.

Each of the plurality of metadata may be metadata for multiple samples of a predetermined sample count in the frame.

The metadata may include metadata for use in performing an interpolation process on gains of samples in the audio signal, the gains being calculated on the basis of the metadata.

The encoding apparatus may further include an interpolation processing section configured to perform an interpolation process on the metadata.

Also according to the second aspect of the present technology, there is provided an encoding method or a program including the steps of encoding an audio signal of an audio object in a frame of a predetermined time segment, and generating a bit stream including encoded audio data obtained by the encoding and a plurality of metadata for the frame.

Thus according to the second aspect of the present technology, an audio signal of an audio object in a frame of a predetermined time segment is encoded, and a bit stream including encoded audio data obtained by the encoding and a plurality of metadata for the frame is generated.

Advantageous Effect of Invention

According to the first and the second aspects of the present technology, sound of higher quality is obtained.

The advantageous effect outlined above is not limitative of the present disclose. Further advantages of the disclosure will be apparent from the ensuing description.

DESCRIPTION OF EMBODIMENTS

Figure 1:
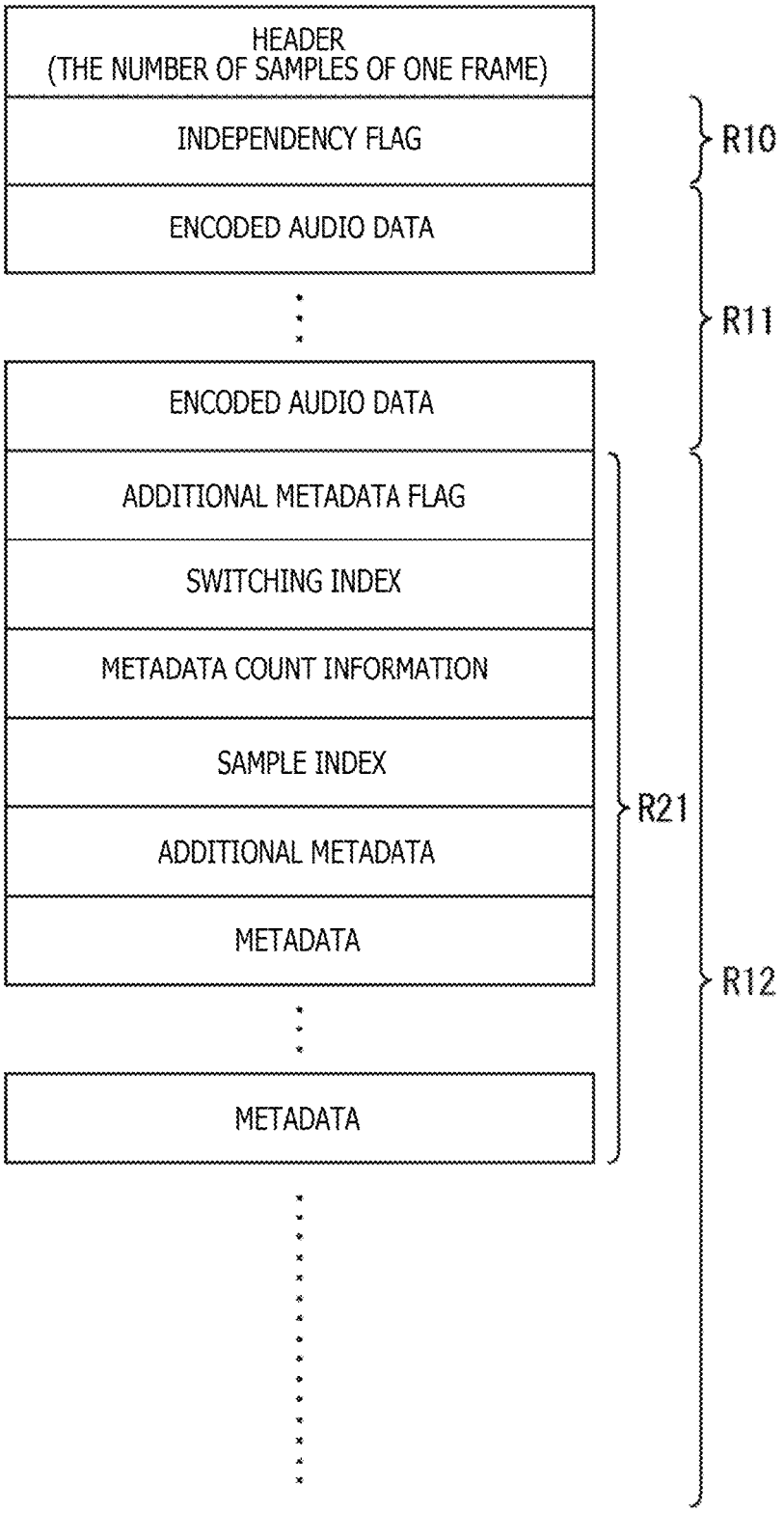
FIG. 1 is a schematic diagram explanatory of a bit stream.

Some preferred embodiments of the present technology are described below with reference to the accompanying drawings.

First Embodiment

Overview of the Present Technology

An object of the present technology is to acquire sound of higher quality when the audio signal of an audio object and the metadata about the audio object such as position information are encoded before being transmitted, with the encoded audio signal and metadata decoded and audibly reproduced on the decoding side. In the description that follows, the audio object may be simply referred to as the object.

The present technology involves encoding a plurality of metadata of the audio signal per frame, i.e., encoding at least two metadata for the audio signal in each frame, before transmitting the encoded metadata.

Also, the metadata in this context refers to metadata for the samples in each frame of the audio signal, i.e., metadata given to the samples. For example, the position of the audio object in a space designated by position information as the metadata points to a timing position at which sound is reproduced from the samples to which the metadata is given.

The metadata may be transmitted by one of the following three methods: a count designation method, a sample designation method, and an automatic switching method. At the time of metadata transmission, the metadata may be transmitted using the three methods being switched one after another for each object or for each frame of a predetermined time segment.

(Count Designation Method)

First, the count designation method is explained below.

The count designation method involves including into a bit stream syntax the metadata count information indicating the number of metadata transmitted per frame, before transmitting the designated number of metadata. The information indicative of the number of samples making up one frame is held in a header of the bit stream.

Further, specific samples for which each metadata to be transmitted are related may be determined in advance for each frame, such as in terms of the positions of equally divided portions of each frame.

For example, suppose that 2048 samples make up one frame and that four metadata are transmitted per frame. In this case, it is assumed that the segment constituting one frame is equally divided by the number of metadata to be transmitted so that a metadata is transmitted with regard to a sample positioned on each boundary between the divisions of the segment. That is, the metadata is transmitted for the samples positioned at intervals of the sample count obtained by dividing the number of samples in one frame by the number of the metadata involved.

In the case above, the metadata is transmitted for the 512th sample, the 1024th sample, the 1536th sample, and the 2048th sample from the beginning of the frame.

Alternatively, where reference sign S stands for the number of samples making up one frame and A for the number of metadata to be transmitted per frame, the metadata may be transmitted for the samples at the positions defined by $S/2^{(A-1)}$. That is, the metadata may be transmitted for all or part of the samples positioned at intervals of $S/2^{(A-1)}$ in the frame. In this case, if the metadata count A is 1, then the metadata is transmitted for the last sample in the frame, for example.

As another alternative, the metadata may be transmitted for the samples positioned at predetermined intervals, i.e., at intervals of a predetermined sample count.

(Sample Designation Method)

Next, the sample designation method is described below.

The sample designation method involves including into the bit stream a sample index indicating the sample position of each metadata before transmitting the bit stream, in addition to the metadata count information transmitted by the above-described count designation method.

For example, suppose that 2048 samples make up one frame and that four metadata are transmitted per frame. It is also assumed that the metadata is transmitted for the 128th sample, the 512th sample, the 1536th sample, and the 2048th sample from the beginning of the frame.

In that case, the bit stream holds the metadata count information indicating "4" as the number of metadata transmitted per frame, and the sample indexes indicating the positions of the 128th sample, the 512th sample, the 1536th sample, and the 2048th sample from the beginning of the frame. For example, a sample index value 128 indicates the position of the 128th sample from the beginning of the frame.

The sample designation method permits transmission of metadata about randomly selected samples in each different frame. This makes it possible, for example, to transmit the metadata for the samples before and after a scene-switching position. In this case, a discontinuous movement of the object can be expressed by rendering, which provides sound of high quality.

(Automatic Switching Method)

The automatic switching method is explained next.

The automatic switching method involves automatically switching the number of metadata to be transmitted per frame depending on the number of samples making up one frame, i.e., depending on the sample count per frame.

For example, if 1024 samples make up one frame, the metadata is transmitted for the respective samples positioned at intervals of 256 samples within the frame. In this example, a total of four metadata are transmitted for the 256th sample, the 512th sample, the 768th sample, and the 1024th sample from the beginning of the frame.

As another example, if 2048 samples make up one frame, the metadata is transmitted for the respective samples positioned at intervals of 256 samples in the frame. In this example, a total of eight metadata are transmitted.

As described above, if at least two metadata are transmitted per frame using the count designation method, the sample designation method, or the automatic switching method, more metadata can be transmitted especially when a large number of samples constitute one frame.

The methods above shorten the segment lining up consecutively the samples whose VBAP gains are calculated by linear interpolation. This provides sound of higher quality.

For example, the shorter the segment lining up consecutively the samples whose VBAP gains are calculated by linear interpolation, the smaller the difference between the value 1 and the sum of squares of the VBAP gains will be for each of the speakers configured. This improves the sense of localization for the sound image of the object.

With the distance between the metadata-furnished samples thus shortened, the difference between the VBAP gains of these samples is also reduced. This permits more accurate rendering of the object movement. Also, with the distance between the metadata-furnished samples shortened, it is possible to shorten the period in which the object appears to move continuously about sound while the object is in fact moving discontinuously. In particular, the sample designation method allows the discontinuous movement of the object to be expressed by transmitting the metadata about suitably positioned samples.

The metadata may be transmitted using one of the above-described count designation method, sample designation method, and automatic switching method. Alternatively, at least two of these three methods may be switched one after another per frame or per object.

For example, suppose that the three methods of the count designation method, the sample designation method, and the automatic switching method are switched one after another for each frame or for each object. In this case, the bit stream may be arranged to hold a switching index indicating the method by which the metadata is transmitted.

In that case, if the value of the switching index is 0, for example, that means the count designation method is selected, i.e., that the metadata is transmitted by the count designation method. If the value of the switching index is 1, that means the sample designation method is selected. If the value of the switching index is 2, that means the automatic switching method is selected. In the ensuing paragraphs, it is assumed that the count designation method, the sample designation method, and the automatic switching method are switched one after another for each frame or for each object.

According to the method of transmitting the audio signal and metadata as defined by the above-mentioned MPEG-H 3D Audio standards, only the metadata about the last sample in each frame is transmitted. It follows that if the VBAP gains of the samples are to be calculated by interpolation process, the VBAP gain of the last sample in the frame immediately preceding the current frame is needed.

Thus, if the reproducing side (decoding side) attempts to randomly access the audio signal of a desired frame to start reproduction therefrom, the interpolation process on VBAP gains cannot be performed because the VBAP gains of the frames preceding the randomly accessed frame are not calculated. For this reason, random access cannot be accomplished under the MPEG-H 3D Audio standards.

In contrast, the present technology permits transmission of the metadata necessary for the interpolation process together with the metadata about each frame or about frames at random intervals. This makes it possible to calculate the VBAP gains of the samples in the frames preceding the current frame or the VBAP gain of the first sample in the current frame, which enables random access. In the ensuing description, the metadata transmitted along with ordinary metadata and used in the interpolation process may be specifically referred to as the additional metadata.

The additional metadata transmitted together with the metadata about the current frame may be the metadata about the last sample in the frame immediately preceding the current frame or the metadata about the first sample in the current frame, for example.

Also, in order to determine easily whether or not there is additional metadata for each frame, the bit stream is arranged to include an additional metadata flag indicating the presence or absence of additional metadata about each object per frame. For example, if the value of the additional metadata flag for a given frame is 1, that means there is additional metadata about the frame. If the value of the additional metadata flag is 0, that means there is no additional metadata about the frame.

Basically, the additional metadata flag has the same value for all objects in the same frame.

As described above, the additional metadata flag is transmitted per frame with additional metadata transmitted as needed. This permits random access to the frames having the additional metadata.

If there is no additional metadata for the frame designated as the destination of random access, the frame temporally closest to the designated frame may be selected as the destination of random access. Thus, if additional metadata is transmitted at appropriate intervals of frames, random access can be achieved without letting the user experience an awkward feeling.

While the additional metadata was explained above, an interpolation process may be carried out on the VBAP gains of the frame designated as the destination of random access without the use of additional metadata. In this case, random access can be accomplished while an increase in the amount of data (bit rate) in the bit stream attributable to the use of additional metadata is minimized.

Specifically, in the frame designated as the destination of random access, interpolation process is performed between the value of the VBAP gain assumed to be 0 for the frames preceding the current frame on the one hand and the value of the VBAP gain calculated for the current frame on the other hand. Alternatively, an interpolation process is not limited to what was described above and may be carried out in such a manner that the value of the VBAP gain of each sample in the current frame becomes the same as the value of the VBAP gain calculated for the current frame. Meanwhile, the frames not designated as the destination of random access are subject to an ordinary interpolation process using the VBAP gains of the frames preceding the current frame.

As described above, the interpolation process performed on VBAP gains may be switched depending on whether or not the frame of interest is designated as the destination of random access. This makes it possible to perform random access without using additional metadata.

According to the above-mentioned MPEG-H 3D Audio standards, the bit stream is arranged to include an independency flag (also called indepFlag) indicating whether or not the current frame is amenable to decoding and rendering using only the data of the current frame in the bit stream (called an independent frame). If the value of the independency flag is 1, that means the current frame can be decoded and rendered without the use of the data about the frames preceding the current frame or any information obtained by decoding such data.

Thus, if the value of the independency flag is 1, it is necessary to decode and render the current frame without using the VBAP gains of the frames preceding the current frame.

Given the frame for which the value of the independency flag is 1, the above-mentioned additional metadata may be included in the bit stream. Alternatively, the interpolation process may be switched as described above.

In this manner, depending on the value of the independency flag, whether or not to include additional metadata into the bit stream may be determined, or the interpolation process on VBAP gains may be switched. Thus, when the value of the independency flag is 1, the current frame can be decoded and rendered without the use of the VBAP gains of the frames preceding the current frame.

Further, it was explained above that according to the above-mentioned MPEG-H 3D Audio standards, the metadata obtained by decoding is only about the representative sample, i.e., about the last sample in the frame. However, on the side where the audio signal and metadata are encoded, there are few metadata defined of all samples in the frame before these metadata are compressed (encoded) for input to the encoding apparatus. That is, many samples yet to be encoded in the frame of the audio signal have no metadata.

At present, it is most often the case that only the samples positioned at regular intervals in the frame, such as the 0th sample, 1024th sample, and 2048th sample, or at irregular intervals such as the 0th sample, 138th sample, and 2044th sample, are given metadata.

In such cases, there may be no metadata-furnished sample depending on the frame. For the frames with no sample having metadata, no metadata is transmitted. Given a frame devoid of samples with metadata, the decoding side needs to calculate the VBAP gains of frames that have metadata and are subsequent to the current frame in order to calculate the VBAP gain of each sample. As a result, delays occur in decoding and rendering the metadata, making it difficult to perform decoding and rendering in real time.

Thus, the present technology involves allowing the encoding side to obtain, as needed, metadata about the samples between those with metadata by an interpolation process (sample interpolation) and permitting the decoding side to decode and render the metadata in real time. There is a need to minimize delays in audio reproduction of video games in particular. It is thus significant for the present technology to reduce the delays in decoding and rendering, i.e., to improve the interactivity of game play, for example.

The interpolation process on metadata may be performed in any suitable form such as linear interpolation or nonlinear interpolation using high-dimensional functions.

<Bit Stream>

Described below are more specific embodiments of the present technology outlined above.

A bit stream depicted in FIG. 1, for example, is output by an encoding apparatus that encodes the audio signal of each object and its metadata.

A header is placed at the beginning of the bit stream depicted in FIG. 1. The header includes information about the number of samples making up one frame, i.e., the sample count per frame, of the audio signal of each object (the information may be referred to as the sample count information hereunder).

In the bit stream, the header is followed by data in each frame. Specifically, a region R10 includes an independency flag indicating whether or not the current frame is an independent frame. A region R11 includes encoded audio data obtained by encoding the audio signal of each object in the same frame.

Also, a region R12 following the region R11 includes encoded metadata obtained by encoding the metadata about each object in the same frame.

For example, a region R21 in the region R12 includes the encoded metadata about one object in one frame.

In this example, the encoded metadata is headed by an additional metadata flag. The additional metadata flag is followed by a switching index.

Further, the switching index is followed by metadata count information and a sample index. This example depicts only one sample index. More particularly, however, the encoded metadata may include as many sample indexes as the number of metadata included in the encoded metadata.

In the encoded metadata, if the switching index indicates the count designation method, then the switching index is followed by the metadata count information but not by a sample index.

Also, if the switching index indicates the sample designation method, the switching index is followed by the metadata count information as well as sample indexes. Further, if the switching index indicates the automatic switching method, the witching index is followed neither by the metadata count information nor by the sample index.

The metadata count information and sample indexes, included as needed, are followed by additional metadata. The additional metadata is followed by a defined number of metadata about each sample.

The additional metadata is included only if the value of the additional metadata flag is 1. If the value of the additional metadata flag is 0, the additional metadata is not included.

In the region R12, the encoded metadata similar to the encoded metadata in the region R21 are lined up for each object.

In the bit stream, single-frame data is constituted by the independency flag included in the region R10, by the encoded audio data about each object in the region R11, and by the encoded metadata about each object in the region R12.

<Typical Configuration of the Encoding Apparatus>

Figure 2:
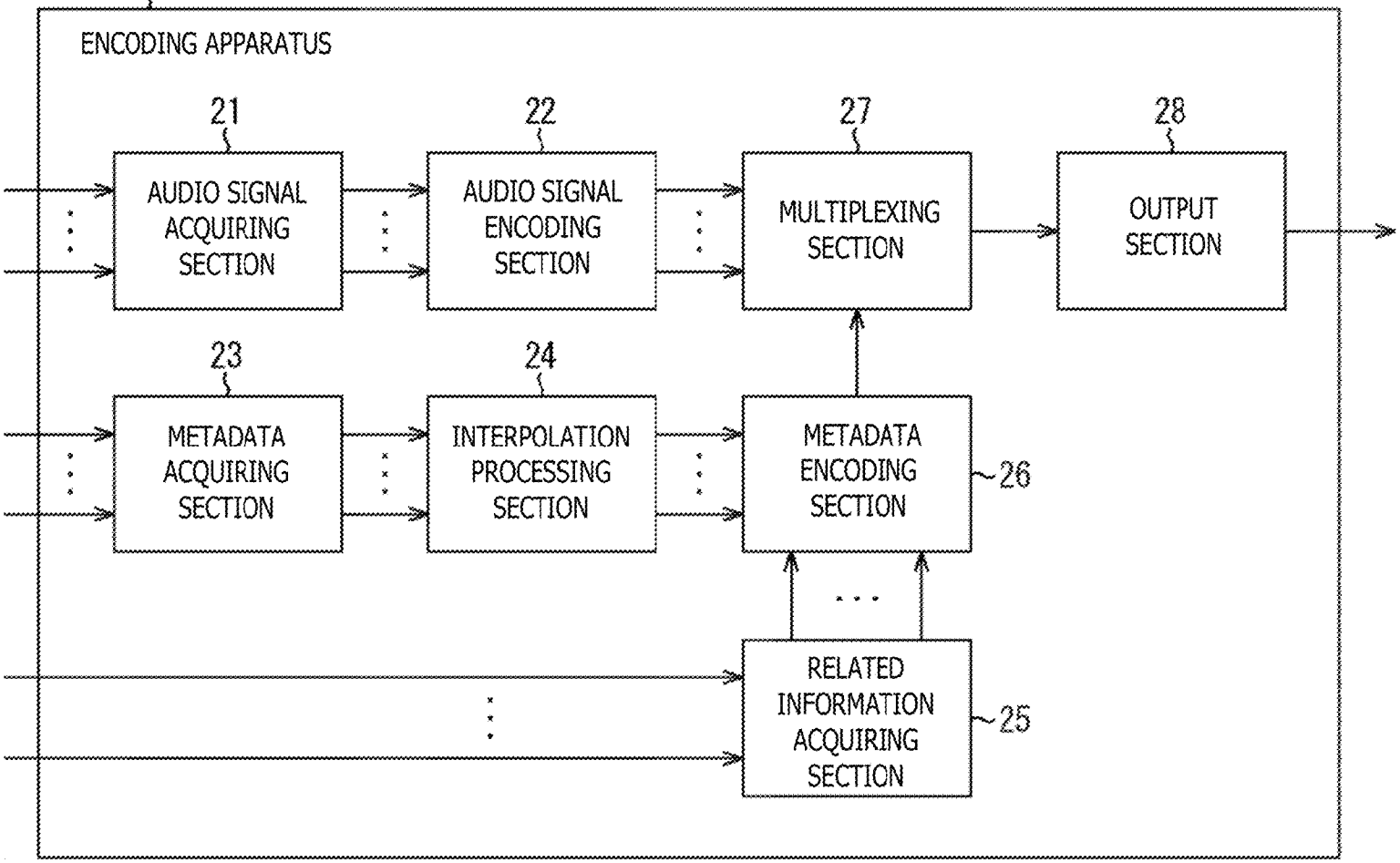
FIG. 2 is a schematic diagram depicting a typical configuration of an encoding apparatus.

Described below is how the encoding apparatus outputting the bit stream depicted in FIG. 1 is configured. FIG. 2 is a schematic diagram depicting a typical configuration of an encoding apparatus to which the present technology is applied.

An encoding apparatus 11 includes an audio signal acquiring section 21, an audio signal encoding section 22, a metadata acquiring section 23, an interpolation processing section 24, a related information acquiring section 25, a metadata encoding section 26, a multiplexing section 27, and an output section 28.

The audio signal acquiring section 21 acquires the audio signal of each object and feeds the acquired audio signal to the audio signal encoding section 22. The audio signal encoding section 22 encodes in units of frames the audio signal fed from the audio signal acquiring section 21, and supplies the multiplexing section 27 with the resulting encoded audio data about each object per frame.

The metadata acquiring section 23 acquires metadata about each object per frame, more specifically the metadata about each sample in the frame, and feeds the acquired metadata to the interpolation processing section 24. The metadata includes, for example, position information indicating the position of the object in a space, degree-of-importance information indicating the degree of importance of the object, and information indicating the degree of spreading of the sound image of the object. The metadata acquiring section 23 acquires the metadata about specific samples (PCM samples) in the audio signal of each object.

The interpolation processing section 24 performs an interpolation process on the metadata fed from the metadata acquiring section 23, thereby generating the metadata about all or a specific part of the samples having no metadata in the audio signal. The interpolation processing section 24 generates by interpolation process the metadata about the samples in the frame in such a manner that the audio signal in one frame of one object will have a plurality of metadata, i.e., that multiple samples in one frame will have metadata.

The interpolation processing section 24 supplies the metadata encoding section 26 with the metadata obtained by interpolation process about each object in each frame.

The related information acquiring section 25 acquires such metadata-related information as information indicating whether the current frame is an independent frame (called the independent frame information), as well as sample count information, information indicating the method of transmitting metadata, information indicating whether additional metadata is transmitted, and information indicating the sample about which the metadata is transmitted regarding each object in each frame of the audio signal. On the basis of the related information thus acquired, the related information acquiring section 25 generates necessary information about each object per frame selected from among the additional metadata flag, the switching index, the metadata count information, and the sample indexes. The related information acquiring section 25 feeds the generated information to the metadata encoding section 26.

Based on the information fed from the related information acquiring section 25, the metadata encoding section 26 encodes the metadata coming from the interpolation processing section 24. The metadata encoding section 26 supplies the multiplexing section 27 with the resulting encoded metadata about each object per frame and with the independent frame information included in the information fed from the related information acquiring section 25.

The multiplexing section 27 generates the bit stream by multiplexing the encoded audio data fed from the audio signal encoding section 22, the encoded metadata fed from the metadata encoding section 26, and the independency flag obtained in accordance with the independent frame information fed from the metadata encoding section 26. The multiplexing section 27 feeds the generated bit stream to the output section 28. The output section 28 outputs the bit stream fed from the multiplexing section 27. That is, the bit stream is transmitted.

<Explanation of the Encoding Process>

Figure 3:
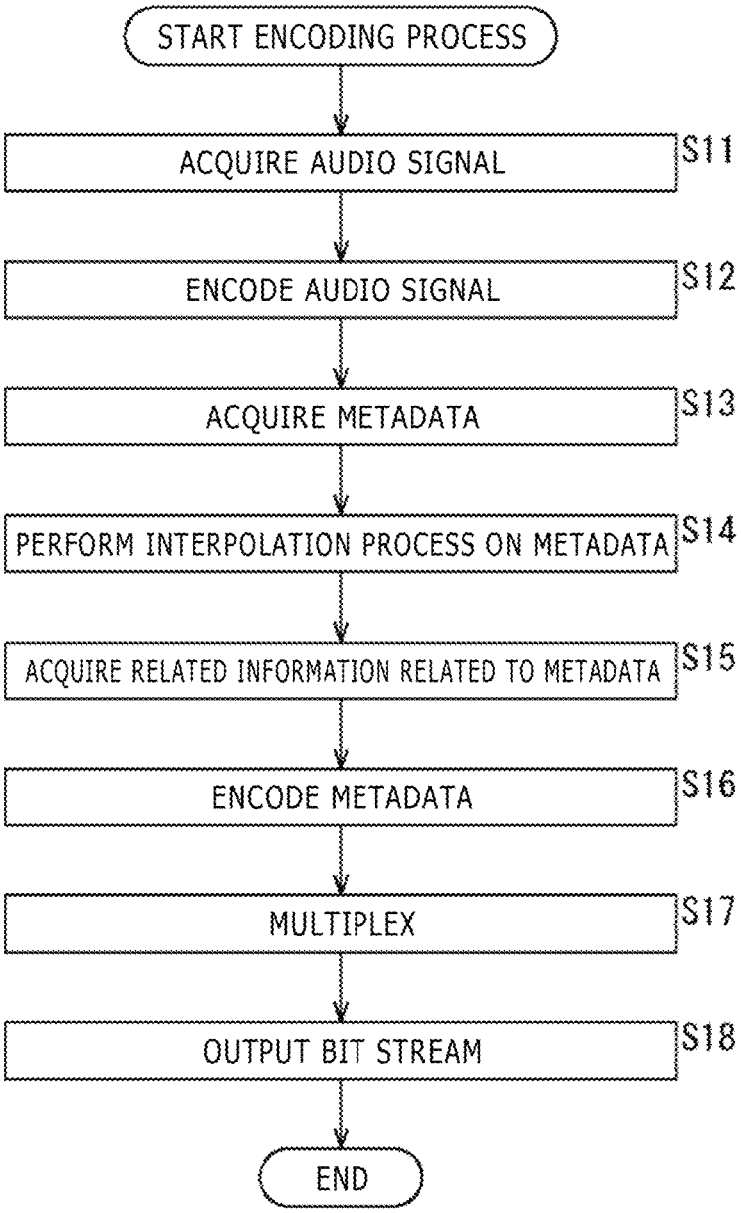
FIG. 3 is a flowchart explanatory of an encoding process.

When supplied with the audio signal of an object from the outside, the encoding apparatus 11 performs an encoding process on the audio signal to output the bit stream. A typical encoding process performed by the encoding apparatus 11 is described below with reference to the flowchart of FIG. 3. The encoding process is performed on each frame of the audio signal.

In step S11, the audio signal acquiring section 21 acquires the audio signal of each object for one frame and feeds the acquired audio signal to the audio signal encoding section 22.

In step S12, the audio signal encoding section 22 encodes the audio signal fed from the audio signal acquiring section 21. The audio signal encoding section 22 supplies the multiplexing section 27 with the resulting encoded audio data about each object for one frame.

For example, the audio signal encoding section 22 may perform modified discrete cosine transform (MDCT) on the audio signal, thereby converting the audio signal from a temporal signal to a frequency signal. The audio signal encoding section 22 also encodes an MDCT coefficient obtained by MDCT and places the resulting scale factor, side information, and quantization spectrum into the encoded audio data acquired by encoding the audio signal.

What is acquired here is the encoded audio data about each object that is placed into the region R11 of the bit stream depicted in FIG. 1, for example.

In step S13, the metadata acquiring section 23 acquires the metadata about each object in each frame of the audio signal, and feeds the acquired metadata to the interpolation processing section 24.

In step S14, the interpolation processing section 24 performs an interpolation process on the metadata fed from the metadata acquiring section 23. The interpolation processing section 24 feeds the resulting metadata to the metadata encoding section 26.

For example, when supplied with one audio signal, the interpolation processing section 24 calculates by linear interpolation the position information about each of the samples located between a given sample and another sample temporally preceding the given sample in accordance with the position information serving as metadata about the given sample and the position information as metadata about the other sample. Likewise, the interpolation processing section 24 performs an interpolation process such as linear interpolation on the degree-of-importance information and degree-of-spreading information of a sound image serving as metadata, thereby generating the metadata about each sample.

In the interpolation process on metadata, the metadata may be calculated in such a manner that all samples of the audio signal of the object in one frame are provided with the metadata. Alternatively, the metadata may be calculated in such a manner that only the necessary samples from among all samples are provided with the metadata. Also, the interpolation process is not limited to linear interpolation. Alternatively, nonlinear interpolation may be adopted for the interpolation process.

In step S15, the related information acquiring section 25 acquires metadata-related information about the frame of the audio signal of each object.

On the basis of the related information thus acquired, the related information acquiring section 25 generates necessary information selected from among the additional metadata flag, the switching index, the metadata count information, and the sample indexes for each object. The related information acquiring section 25 feeds the generated information to the metadata encoding section 26.

The related information acquiring section 25 may not be required to generate the additional metadata flag, the switching index, and other information. Alternatively, the related information acquiring section 25 may acquire the additional metadata flag, the switching index, and other information from the outside instead of generating such information.

In step S16, the metadata encoding section 26 encodes the metadata fed from the interpolation processing section 24 in accordance with such information as the additional metadata flag, the switching index, the metadata count information, and the sample indexes fed from the related information acquiring section 25.

The encoded metadata is generated in such a manner that, of the metadata about each sample in the frame of the audio signal regarding each object, only the sample count information, the method indicated by the switching index, the metadata count information, and the sample position defined by the sample indexes are transmitted. Either the metadata about the first sample in the frame or the retained metadata about the last sample in the immediately preceding frame is included as additional metadata if necessary.

In addition to the metadata, the encoded metadata includes the additional metadata flag and the switching index. The metadata count information, the sample index, and the additional metadata may also be included as needed in the encoded metadata.

What is obtained here is the encoded metadata about each object held in the region R12 of the bit stream depicted in FIG. 1, for example. The encoded metadata held in the region R21 is about one object for one frame, for example.

In this case, if the count designation method is selected in the frame to be processed for the object and if the additional metadata is transmitted, what is generated here is the encoded metadata made up of the additional metadata flag, the switching index, the metadata count information, the additional metadata, and the metadata.

Also, if the sample designation method is selected in the frame to be processed for the object and if the additional metadata is not transmitted, what is generated in this case is the encoded metadata made up of the additional metadata flag, the switching index, the metadata count information, the sample indexes, and the metadata.

Furthermore, if the automatic switching method is selected in the frame to be processed for the object and if the additional metadata is transmitted, what is generated here is the encoded metadata made up of the additional metadata flag, the switching index, the additional metadata, and the metadata.

The metadata encoding section 26 supplies the multiplexing section 27 with the encoded metadata about each object obtained by encoding the metadata and with the independent frame information included in the information fed from the related information acquiring section 25.

In step S17, the multiplexing section 27 generates the bit stream by multiplexing the encoded audio data fed from the audio signal encoding section 22, the encoded metadata fed from the metadata encoding section 26, and the independency flag obtained on the basis of the independent frame information fed from the metadata encoding section 26. The multiplexing section 27 feeds the generated bit stream to the output section 28.

What is generated here is a single-frame bit stream made up of the regions R10 to R12 of the bit stream depicted in FIG. 1, for example.

In step S18, the output section 28 outputs the bit stream fed from the multiplexing section 27. This terminates the encoding process. If a leading portion of the bit stream is output, then the header containing primarily the sample count information is also output as depicted in FIG. 1.

In the manner described above, the encoding apparatus 11 encodes the audio signal and the metadata, and outputs the bit stream composed of the resulting encoded audio data and encoded metadata.

At this point, if a plurality of metadata are arranged to be transmitted for each frame, the decoding side may further shorten the segment lining up the samples whose VBAP gains are calculated by interpolation process. This provides sound of higher quality.

Also, where the interpolation process is performed on the metadata, at least one metadata is always transmitted for each frame. This allows the decoding side to perform decoding and rendering in real time. Additional metadata, which may be transmitted as needed, allows random access to be implemented.

<Typical Configuration of the Decoding Apparatus>

Figure 4:
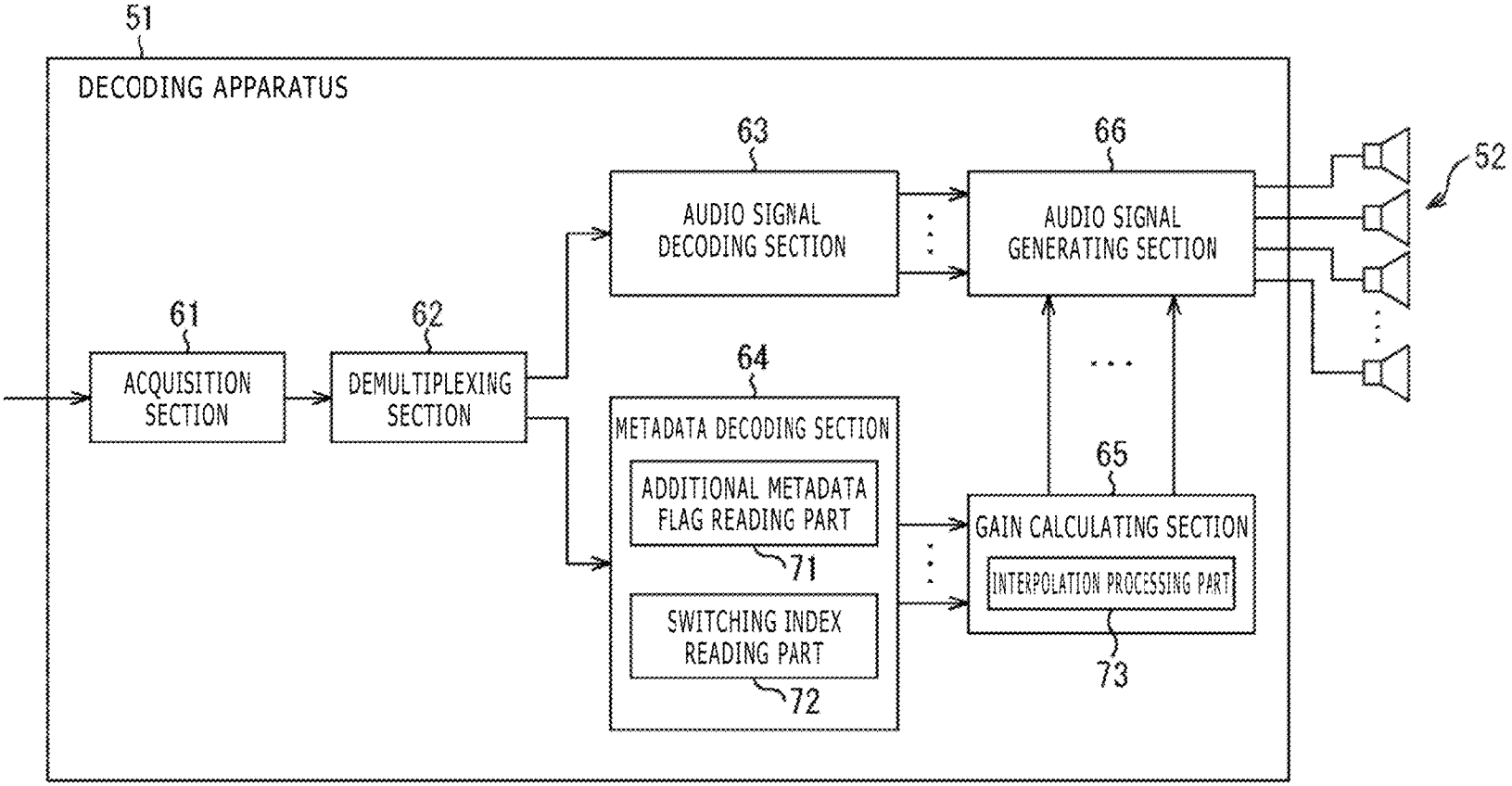
FIG. 4 is a schematic diagram depicting a typical configuration of a decoding apparatus.

Described below is a decoding apparatus that decodes a received (acquired) bit stream output from the encoding apparatus 11. A decoding apparatus to which the present technology is applied is configured as depicted in FIG. 4, for example.

A decoding apparatus 51 of this configuration is connected with a speaker system 52 made up of multiple speakers arranged in a sound reproduction space. The decoding apparatus 51 feeds the audio signal obtained by decoding and rendering for each channel to the speakers on the channels constituting the speaker system 52 for sound reproduction.

The decoding apparatus 51 includes an acquisition section 61, a demultiplexing section 62, an audio signal decoding section 63, a metadata decoding section 64, a gain calculating section 65, and an audio signal generating section 66.

The acquisition section 61 acquires a bit stream output from the encoding apparatus 11 and feeds the acquired bit stream to the demultiplexing section 62. The demultiplexing section 62 demultiplexes the bit stream fed from the acquisition section 61 into an independency flag, encoded audio data, and encoded metadata. The demultiplexing section 62 feeds the encoded audio data to the audio signal decoding section 63 and the independency flag and the encoded metadata to the metadata decoding section 64.

As needed, the demultiplexing section 62 may read various items of information such as the sample count information from the header of the bit stream. The demultiplexing section 62 feeds the retrieved information to the audio signal decoding section 63 and the metadata decoding section 64.

The audio signal decoding section 63 decodes the encoded audio data fed from the demultiplexing section 62, and feeds the resulting audio signal of each object to the audio signal generating section 66.

The metadata decoding section 64 decodes the encoded metadata fed from the demultiplexing section 62, and supplies the gain calculating section 65 with the resulting metadata about each object in each frame of the audio signal and with the independency flag fed from the demultiplexing section 62.

The metadata decoding section 64 includes an additional metadata flag reading part 71 that reads the additional metadata flag from the encoded metadata and a switching index reading part 72 that reads the switching index from the encoded metadata.

The gain calculating section 65 calculates the VBAP gains of the samples in each frame of the audio signal regarding each object based on arranged position information indicating the position of each speaker arranged in space made up of the speaker system 52 held in advance, on the metadata about each object per frame fed from the metadata decoding section 64, and on the independency flag.

Also, the gain calculating section 65 includes an interpolation processing part 73 that calculates, on the basis of the VBAP gains of predetermined samples, the VBAP gains of other samples by interpolation process.

The gain calculating section 65 supplies the audio signal generating section 66 with the VBAP gain calculated regarding each object of each of the samples in the frame of the audio signal.

The audio signal generating section 66 generates the audio signal on each channel, i.e., the audio signal to be fed to the speaker of each channel, in accordance with the audio signal of each object fed from the audio signal decoding section 63 and with the VBAP gain of each sample per object fed from the gain calculating section 65.

The audio signal generating section 66 feeds the generated audio signal to each of the speakers constituting the speaker system 52 so that the speakers will output sound based on the audio signal.

In the decoding apparatus 51, a block made up of the gain calculating section 65 and the audio signal generating section 66 functions as a renderer (rendering section) that performs rendering based on the audio signal and metadata obtained by decoding.

<Explanation of the Decoding Process>

Figure 5:
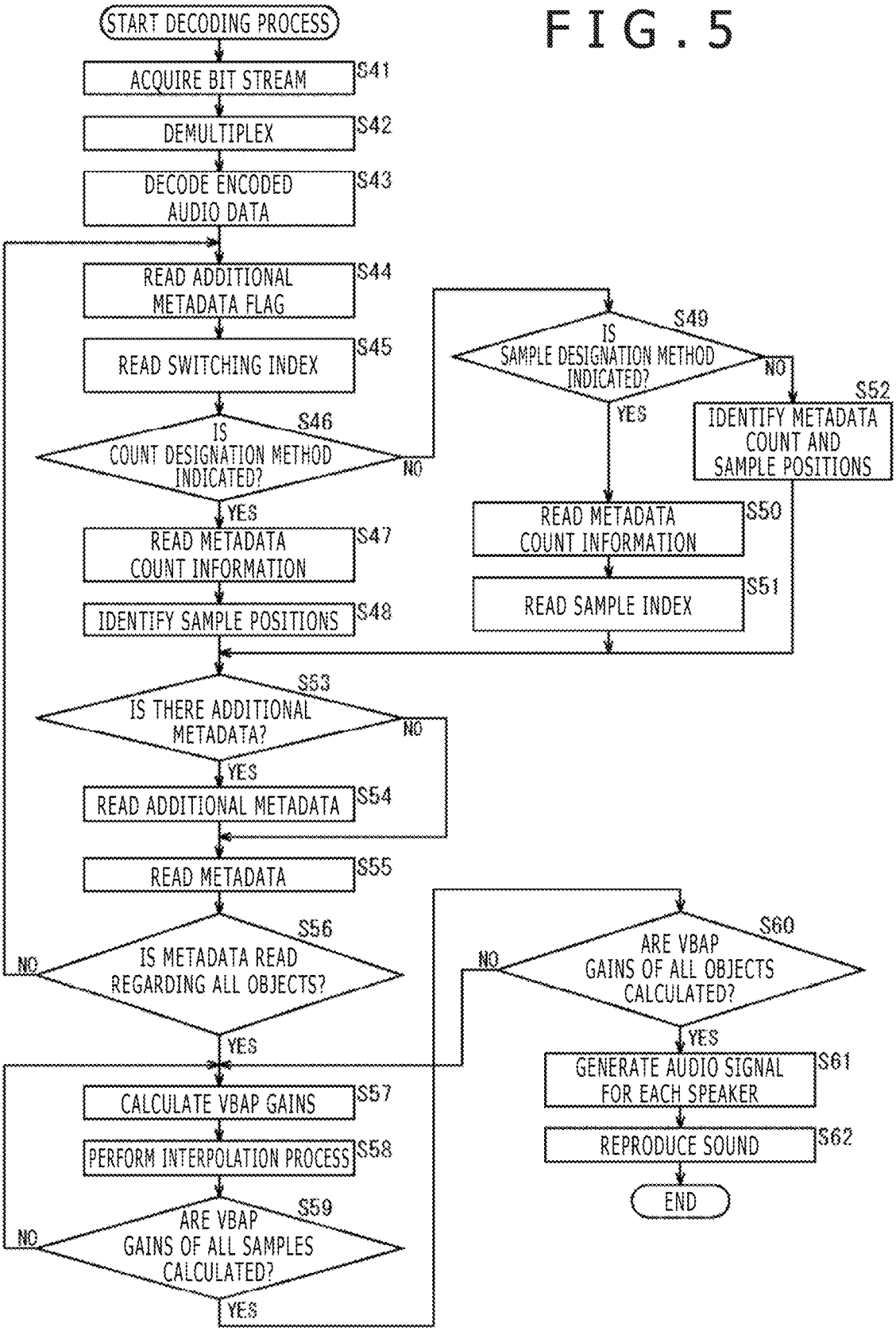
FIG. 5 is a flowchart explanatory of a decoding process.

When a bit stream is transmitted from the encoding apparatus 11, the decoding apparatus 51 performs a decoding process to receive (acquire) and decode the bit stream. A typical decoding process performed by the decoding apparatus 51 is described below with reference to the flowchart of FIG. 5. This decoding process is carried out on each frame of the audio signal.

In step S41, the acquisition section 61 acquires the bit stream output from the encoding apparatus 11 for one frame and feeds the acquired bit stream to the demultiplexing section 62.

In step S42, the demultiplexing section 62 demultiplexes the bit stream fed from the acquisition section 61 into an independency flag, encoded audio data, and encoded metadata. The demultiplexing section 62 feeds the encoded audio data to the audio signal decoding section 63 and the independency flag and the encoded metadata to the metadata decoding section 64.

At this point, the demultiplexing section 62 supplies the metadata decoding section 64 with the sample count information read from the header of the bit stream. The sample count information may be arranged to be fed at the time the header of the bit stream is acquired.

In step S43, the audio signal decoding section 63 decodes the encoded audio data fed from the demultiplexing section 62 and supplies the audio signal generating section 66 with the resulting audio signal of each object for one frame.

For example, the audio signal decoding section 63 obtains an MDCT coefficient by decoding the encoded audio data. Specifically, the audio signal decoding section 63 calculates the MDCT coefficient based on scale factor, side information, and quantization spectrum supplied as the encoded audio data.

Also, on the basis of the MDCT coefficient, the audio signal decoding section 63 performs inverse modified discrete cosine transform (IMDCT) to obtain PCM data. The audio signal decoding section 63 feeds the resulting PCM data to the audio signal generating section 66 as the audio signal.

Decoding of the encoded audio data is followed by decoding of the encoded metadata. That is, in step S44, the additional metadata flag reading part 71 in the metadata decoding section 64 reads the additional metadata flag from the encoded metadata fed from the demultiplexing section 62.

For example, the metadata decoding section 64 successively targets for processing the objects corresponding to the encoded metadata fed consecutively from the demultiplexing section 62. The additional metadata flag reading part 71 reads the additional metadata flag from the encoded metadata about each target object.

In step S45, the switching index reading part 72 in the metadata decoding section 64 reads the switching index from the encoded metadata about the target object fed from the demultiplexing section 62.

In step S46, the switching index reading part 72 determines whether or not the method indicated by the switching index read in step S45 is the count designation method.

If it is determined in step S46 that the count designation method is indicated, control is transferred to step S47. In step S47, the metadata decoding section 64 reads the metadata count information from the encoded metadata about the target object fed from the demultiplexing section 62.

The encoded metadata about the target object includes as many metadata as the metadata count indicated by the metadata count information read in the manner described above.

In step S48, the metadata decoding section 64 identifies the sample positions in the transmitted metadata about the target object in the frame of the audio signal, the identification being based on the metadata count information read in step S47 and on the sample count information fed from the demultiplexing section 62.

For example, the single-frame segment made up of as many samples as the sample count indicated by the sample count information is divided into as many equal segments as the metadata count indicated by the metadata count information. The position of the last sample in each divided segment is regarded as the metadata sample position, i.e., the position of the sample having metadata. The sample positions thus obtained are the positions of the samples in each metadata included in the encoded metadata; these are the samples having the metadata.

It was explained above that the metadata about the last sample in each of the divisions from the single-frame segment is transmitted. The sample positions for each metadata are calculated using the sample count information and metadata count information in accordance with each specific sample about which the metadata is to be transmitted.

After the number of metadata included in the encoded metadata about the target object is identified and after the sample positions for each metadata are identified, control is transferred to step S53.

On the other hand, if it is determined in step S46 that the count designation method is not indicated, control is transferred to step S49. In step S49, the switching index reading part 72 determines whether or not the sample designation method is indicated by the switching index read in step S45.

If it is determined in step S49 that the sample designation method is indicated, control is transferred to step S50. In step S50, the metadata decoding section 64 reads the metadata count information from the encoded metadata about the target object fed from the demultiplexing section 62.

In step S51, the metadata decoding section 64 reads sample indexes from the encoded metadata about the target object fed from the demultiplexing section 62. What is read at this point are as many sample indexes as the metadata count indicated by the metadata count information.

Given the metadata count information and the sample indexes read out in this manner, it is possible to identify the number of metadata included in the encoded metadata about the target object as well as the sample positions for these metadata.

After the number of metadata included in the encoded metadata about the target object is identified and after the sample positions for each metadata are identified, control is transferred to step S53.

If it is determined in step S49 that the sample designation method is not indicated, i.e., that the automatic switching method is indicated by the switching index, control is transferred to step S52.

In step S52, based on the sample count information fed from the demultiplexing section 62, the metadata decoding section 64 identifies the number of metadata included in the encoded metadata about the target object as well as the sample positions for each metadata. Control is then transferred to step S53.

For example, the automatic switching method involves determining in advance the number of metadata to be transmitted with regard to the number of samples making up one frame, as well as the sample positions for each metadata, i.e., specific samples about which the metadata is to be transmitted.

For that reason, given the sample count information, the metadata decoding section 64 can identify the number of metadata included in the encoded metadata about the target object and also identify the sample positions for these metadata.

After step S48, step S51, or step S52, control is transferred to step S53. In step S53, the metadata decoding section 64 determines whether or not there is additional metadata on the basis of the value of the additional metadata flag read out in step S44.

If it is determined in step S53 that there is additional metadata, control is transferred to step S54. In step S54, the metadata decoding section 64 reads the additional metadata from the encoded metadata about the target object. With the additional metadata read out, control is transferred to step S55.

In contrast, if it is determined in step S53 that there is no additional metadata, step S54 is skipped and control is transferred to step S55.

After the additional metadata is read out in step S54, or if it is determined in step S53 that there is no additional metadata, control is transferred to step S55. In step S55, the metadata decoding section 64 reads the metadata from the encoded metadata about the target object.

At this point, what is read from the encoded metadata are as many metadata as the count identified in the above-described steps.

In the above-described process, the metadata and the additional metadata about the target object are read from the audio signal for one frame.

The metadata decoding section 64 feeds the retrieved metadata to the gain calculating section 65. At this point, the metadata are fed in such a manner that the gain calculating section 65 can identify which metadata relates to which sample of which object. Also, if additional metadata is read out, the metadata decoding section 64 feeds the retrieved additional metadata to the gain calculating section 65.

In step S56, the metadata decoding section 64 determines whether or not the metadata has been read regarding all objects.

If it is determined in step S56 that the metadata has yet to be read regarding all objects, control is returned to step S44 and the subsequent steps are repeated. In this case, another object yet to be processed is selected as the new target object, and the metadata and other information are read from the encoded metadata regarding the new object.

In contrast, if it is determined in step S56 that the metadata has been read regarding all objects, the metadata decoding section 64 supplies the gain calculating section 65 with the independency flag fed from the demultiplexing section 62. Control is then transferred to step S57 and rendering is started.

That is, in step S57, the gain calculating section 65 calculates VBAP gains based on the metadata, additional metadata, and independency flag fed from the metadata decoding section 64.

For example, the gain calculating section 65 selects one target object after another for processing, and also selects one target sample after another with metadata in the frame of the audio signal of each target object.

Given a target sample, the gain calculating section 65 calculates by VBAP the VBAP gain of the target sample for each channel, i.e., the VBAP gain of the speaker for each channel, based on the position of the object in space indicated by the position information serving as the metadata about the sample and on the position in space of each of the speakers making up the speaker system 52, the speaker positions being indicated by the arranged position information.

VBAP allows two or three speakers placed around a given object to output sound with predetermined gains so that a sound image may be localized at the position of the object. A detailed description of VBAP is given, for example, by Ville Pulkki, "Virtual Sound Source Positioning Using Vector Base Amplitude Panning," Journal of AES, vol. 45, no. 6, pp. 456-466, 1997.

In step S58, the interpolation processing part 73 performs an interpolation process to calculate the VBAP gains of each of the speakers regarding the samples having no metadata.

For example, the interpolation process involves using the VBAP gain of the target sample calculated in the preceding step S57 and the VBAP gain of a sample having metadata in the same frame as the target object or in the immediately preceding frame (the latter sample may be referred to as the reference sample hereunder), the latter sample being temporally preceding the target sample. That is, linear interpolation is typically performed to calculate, for each of the speakers (channels) making up the speaker system 52, the VBAP gains of the samples between the target sample and the reference sample using the VBAP gain of the target sample and the VBAP gain of the reference sample.

For example, if random access is designated, or if the value of the independency flag fed from the metadata decoding section 64 is 1 and there is additional metadata, the gain calculating section 65 calculates the VBAP gains using the additional metadata.

Specifically, suppose that the first sample having metadata in the frame of the audio signal of the target object is targeted for processing and that the VBAP gain of the target sample is calculated. In this case, the VBAP gains of the frames preceding the current frame are not calculated. Thus, the gain calculating section 65 regards the first sample in the current frame or the last sample in the immediately preceding frame as the reference sample and calculates the VBAP gain of the reference sample using the additional metadata.

The interpolation processing part 73 then calculates by interpolation process the VBAP gains of the samples between the target sample and the reference sample using the VBAP gain of the target sample and the VBAP gain of the reference sample.

On the other hand, if random access is designated, or if the value of the independency flag fed from the metadata decoding section 64 is 1 and there is no additional metadata, the VBAP gains are not calculated using the additional metadata. Instead, the interpolation process is switched.

Specifically, suppose that the first sample with metadata in the frame of the audio signal of the target object is regarded as the target sample and that the VBAP gain of the target sample is calculated. In this case, no VBAP gains are calculated regarding the frames preceding the current frame. Thus, the gain calculating section 65 regards the first sample in the current frame or the last sample in the immediately preceding frame as the reference sample, and sets 0 as the VBAP gain of the reference sample for gain calculation.

The interpolation processing part 73 then performs an interpolation process to calculate the VBAP gains of the samples between the target sample and the reference sample using the VBAP gain of the target sample and the VBAP gain of the reference sample.

The interpolation process is not limited to what was descried above. Alternatively, the interpolation process may be performed in such a manner that the VBAP gain of each of the samples to be interpolated becomes the same as the VBAP value of the target sample, for example.

When the interpolation process on VBAP gains is switched as described above, it is possible to perform random access to the frames having no additional metadata and to carry out decoding and rendering of independent frames.

It was explained in the above example that the VBAP gains of the samples having no metadata are obtained using the interpolation process. Alternatively, the metadata decoding section 64 may perform an interpolation process to obtain the metadata about the samples having no metadata. In this case, the metadata about all samples of the audio signal is obtained, so that the interpolation processing part 73 does not perform the interpolation process on VBAP gains.

In step S59, the gain calculating section 65 determines whether or not the VBAP gains of all samples in the frame of the audio signal of the target object have been calculated.

If it is determined in step S59 that the VBAP gains have yet to be calculated of all samples, control is returned to step S57 and the subsequent steps are repeated. That is, the next sample having metadata is selected as the target sample, and the VBAP gain of the target sample is calculated.

On the other hand, if it is determined in step S59 that the VBAP gains have been calculated of all samples, control is transferred to step S60. In step S60, the gain calculating section 65 determines whether or not the VBAP gains of all objects have been calculated.

For example, if all objects are targeted for processing and if the VBAP gains of the samples of each object for each speaker are calculated, then it is determined that the VBAP gains of all objects have been calculated.

If it is determined in step S60 that the VBAP gains have yet to be calculated of all objects, control is returned to step S57 and the subsequent steps are repeated.

On the other hand, if it is determined in step S60 that the VBAP gains have been calculated of all objects, the gain calculating section 65 feeds the calculated VBAP gains to the audio signal generating section 66. Control is then transferred to step S61. In this case, the audio signal generating section 66 is supplied with the VBAP gain of each sample in the frame of the audio signal of each object calculated for each speaker.

In step S61, the audio signal generating section 66 generates the audio signal for each speaker based on the audio signal of each object fed from the audio signal decoding section 63 and on the VBAP gain of each sample of each object fed from the gain calculating section 65.

For example, the audio signal generating section 66 generates the audio signal for a given speaker by adding up signals each obtained by multiplying the audio signal of each object for each sample by the VBAP gain obtained of the object for the same speaker.

Specifically, suppose that, as the object, there are three objects OB1 to OB3 and that VBAP gains G1 to G3 of these objects have been obtained for a given speaker SP1 constituting part of the speaker system 52. In this case, the audio signal of the object OB1 multiplied by the VBAP gain G1, the audio signal of the object OB2 multiplied by the VBAP gain G2, and the audio signal of the object OB3 multiplied by the VBAP gain G3 are added up. An audio signal resulting from the addition is the audio signal to be fed to the speaker SP1.

In step S62, the audio signal generating section 66 supplies each speaker of the speaker system 52 with the audio signal obtained for the speaker in step S61, causing the speakers to reproduce sound based on these audio signals. This terminates the decoding process. In this manner, the speaker system 52 reproduces the sound of each object.

In the manner described above, the decoding apparatus 51 decodes encoded audio data and encoded metadata, and performs rendering on the audio signal and metadata obtained by decoding to generate the audio signal for each speaker.

In carrying out rendering, the decoding apparatus 51 obtains multiple metadata for each frame of the audio signal of each object. It is thus possible to shorten the segment lining up the samples whose VBAP gains are calculated using the interpolation process. This not only provides sound of higher quality but also allows decoding and rendering to be performed in real time. Because some frames have additional metadata included in encoded metadata, it is possible to implement random access as well as decoding and rendering of independent frames. Further, in the case of frames not including additional metadata, the interpolation process on VBAP gains may be switched to also permit random access as well as decoding and rendering of independent frames.

The series of processes described above may be executed either by hardware or by software. Where these processes are to be carried out by software, the programs constituting the software are installed into a suitable computer. Variations of the computer include one with the software installed beforehand in its dedicated hardware, and a general-purpose personal computer or like equipment capable of executing diverse functions based on the programs installed therein.

Figure 6:
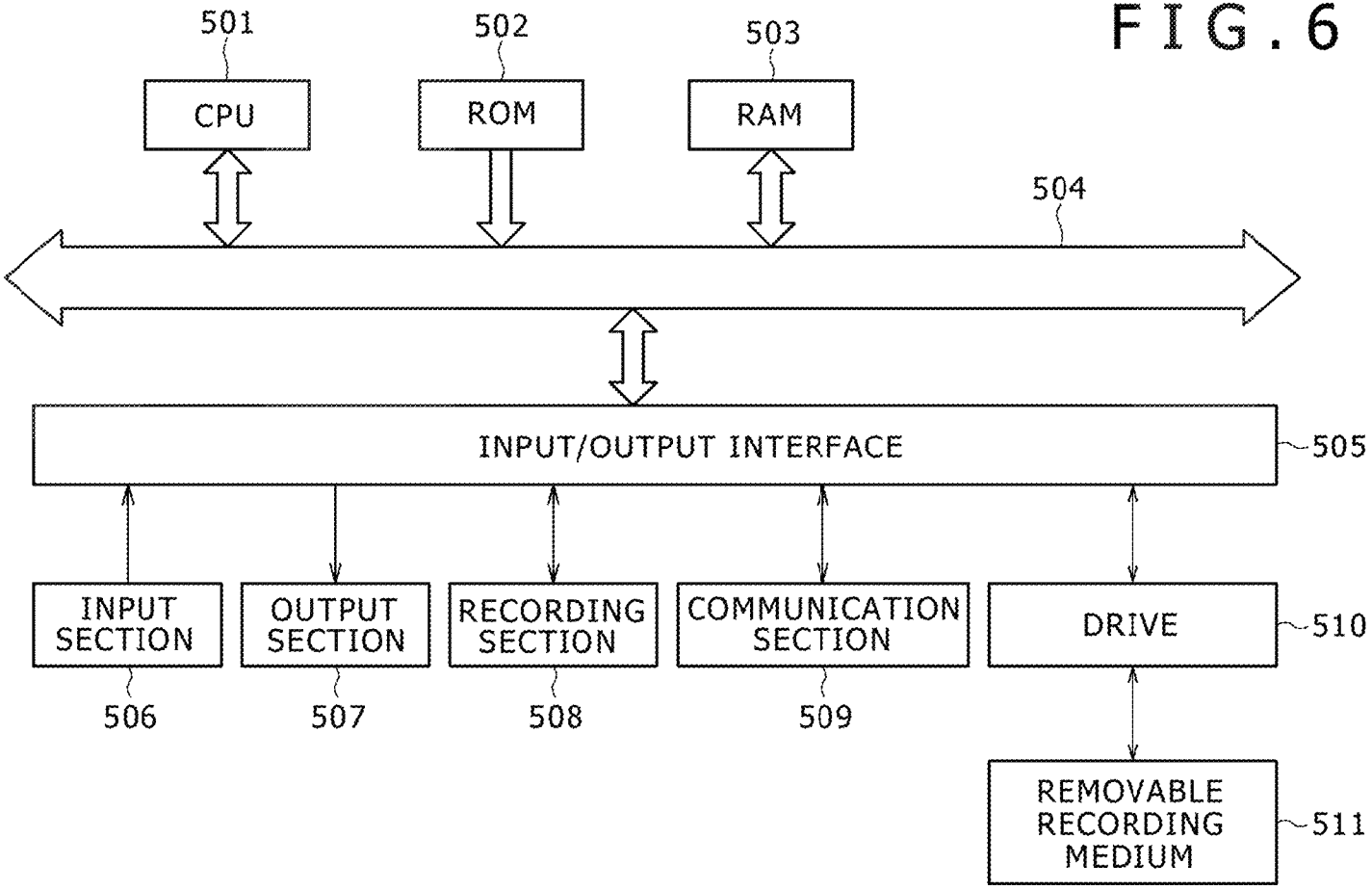
FIG. 6 is a block diagram depicting a typical configuration of a computer.

FIG. 6 is a block diagram depicting a typical configuration of a hardware of a computer capable of performing the above-described series of processes using programs.

In the computer, a central processing unit (CPU) 501, a read-only memory (ROM) 502, and a random access memory (RAM) 503 are interconnected mutually by a bus 504.

The bus 504 is further connected with an input/output interface 505. The input/output interface 505 is connected with an input section 506, an output section 507, a recording section 508, a communication section 509, and a drive 510.

The input section 506 is made up of a keyboard, a mouse, a microphone, and an imaging element, for example. The output section 507 is formed by a display and speakers, for example. The recording section 508 is typically constituted by a hard disk and a nonvolatile memory. The communication section 509 is composed of a network interface, for example. The drive 510 drives a removable recording medium 511 such as a magnetic disk, an optical disk, a magneto-optical disk, or a semiconductor memory.

In the computer configured as outlined above, the CPU 501 performs the series of processes explained above by executing, for example, a program loaded from the recording section 508 into the RAM 503 via the input/output interface 505 and bus 504.

The program executed by the computer (i.e., CPU 501) may be recorded on the removable recording medium 511 when offered, the removable recording medium 511 typically constituting a software package. Also, the program may be offered via wired or wireless transmission media such as a local area network, the Internet, or a digital satellite service.

In the computer, the program may be installed into the recording section 508 after being read via the input/output interface 505 from the removable recording medium 511 placed into the drive 510. Alternatively, the program may be received by the communication section 509 via the wired or wireless transmission media and installed into the recording section 508. As another alternative, the program may be preinstalled in the ROM 502 or in the recording section 508.

The programs to be executed by the computer may be processed chronologically, i.e., in the sequence depicted in this description; in parallel, or in otherwise appropriately timed fashion such as when they are invoked as needed.

The embodiments of the present technology are not limited to those discussed above. The embodiments may be modified, altered, or improved in diverse fashion within the scope and spirit of the present technology.

For example, the present technology may be carried out in a cloud computing configuration in which each function is shared and commonly managed by multiple apparatuses via a network.

Further, each of the steps explained in connection with the flowcharts above may be performed either by a single apparatus or by multiple apparatuses in a sharing manner.

Furthermore, if a single step includes multiple processes, these processes included in the single step may be carried out either by a single apparatus or by multiple apparatuses in a sharing manner.

The present technology may be further configured preferably as follows:

(1)

A decoding apparatus including:

an acquisition section configured to acquire both encoded audio data obtained by encoding an audio signal of an audio object in a frame of a predetermined time segment and a plurality of metadata for the frame;

a decoding section configured to decode the encoded audio data; and a rendering section configured to perform rendering based on the audio signal obtained by the decoding and on the metadata.

(2)

The decoding apparatus as stated in paragraph (1) above, in which the metadata include position information indicating a position of the audio object.

(3)

The decoding apparatus as stated in paragraph (1) or (2) above, in which each of the plurality of metadata is metadata for multiple samples in the frame of the audio signal.

(4)

The decoding apparatus as stated in paragraph (3) above, in which each of the plurality of metadata is metadata for multiple samples counted by dividing the number of the samples making up the frame by the number of the metadata.

(5)

The decoding apparatus as stated in paragraph (3) above, in which each of the plurality of metadata is metadata for multiple samples indicated by each of multiple sample indexes.

(6)

The decoding apparatus as stated in paragraph (3) above, in which each of the plurality of metadata is metadata for multiple samples of a predetermined sample count in the frame.

(7)

The decoding apparatus as stated in any one of paragraphs (1) to (6) above, in which the metadata include metadata for use in performing an interpolation process on gains of samples in the audio signal, the gains being calculated on the basis of the metadata.

(8)

A decoding method including the steps of:

acquiring both encoded audio data obtained by encoding an audio signal of an audio object in a frame of a predetermined time segment and a plurality of metadata for the frame;

decoding the encoded audio data; and performing rendering based on the audio signal obtained by the decoding and on the metadata.

(9)

A program for causing a computer to perform a process including the steps of:

acquiring both encoded audio data obtained by encoding an audio signal of an audio object in a frame of a predetermined time segment and a plurality of metadata for the frame;

decoding the encoded audio data; and performing rendering based on the audio signal obtained by the decoding and on the metadata.

(10)

An encoding apparatus including:

an encoding section configured to encode an audio signal of an audio object in a frame of a predetermined time segment; and a generation section configured to generate a bit stream including encoded audio data obtained by the encoding and a plurality of metadata for the frame.

(11)

The encoding apparatus as stated in paragraph (10) above, in which the metadata include position information indicating a position of the audio object.

(12)

The encoding apparatus as stated in paragraph (10) or (11) above, in which each of the plurality of metadata is metadata for multiple samples in the frame of the audio signal.

(13)

The encoding apparatus as stated in paragraph (12) above, in which each of the plurality of metadata is metadata for multiple samples counted by dividing the number of the samples making up the frame by the number of the metadata.

(14)

The encoding apparatus as stated in paragraph (12) above, in which each of the plurality of metadata is metadata for multiple samples indicated by each of multiple sample indexes.

(15)

The encoding apparatus as stated in paragraph (12) above, in which each of the plurality of metadata is metadata for multiple samples of a predetermined sample count in the frame.

(16)

The encoding apparatus as stated in any one of paragraphs (10) to (15) above, in which the metadata include metadata for use in performing an interpolation process on gains of samples in the audio signal, the gains being calculated on the basis of the metadata.

(17)

The encoding apparatus as stated in any one of paragraphs (10) to (16) above, further including:

an interpolation processing section configured to perform an interpolation process on the metadata.

(18)

An encoding method including the steps of:

encoding an audio signal of an audio object in a frame of a predetermined time segment; and generating a bit stream including encoded audio data obtained by the encoding and a plurality of metadata for the frame.

(19)

A program for causing a computer to perform a process including the steps of:

encoding an audio signal of an audio object in a frame of a predetermined time segment; and generating a bit stream including encoded audio data obtained by the encoding and a plurality of metadata for the frame.

REFERENCE SIGNS LIST

11 Encoding apparatus, 22 Audio signal encoding section, 24 Interpolation processing section, 25 Related information acquiring section, 26 Metadata encoding section, 27 Multiplexing section, 28 Output section, 51 Decoding apparatus, 62 Demultiplexing section, 63 Audio signal decoding section, 64 Metadata decoding section, 65 Gain calculating section, 66 Audio signal generating section, 71 Additional metadata flag reading part, 72 Switching index reading part, 73 Interpolation processing part

The invention claimed is:

1. A decoding apparatus comprising:

an acquisition section configured to acquire a bitstream including encoded audio data obtained by encoding an audio signal of an audio object in a frame of a predetermined time segment and encoded data of a plurality of metadata for the frame;

an audio data decoding section configured to decode the encoded audio data;

a metadata decoding section configured to decode the encoded data of the plurality of metadata; and a rendering section configured to:

in response to determining that vector base amplitude panning (VBAP) gains of a plurality of samples in the frame of the audio signal of the audio object have been calculated, perform rendering based on the audio signal obtained by the audio data decoding section and on the metadata obtained by the metadata decoding section, and in response to determining that the VBAP gains of the plurality of samples in the frame of the audio signal of the audio object have not been calculated, return to calculation of the VBAP gains, wherein the number of the metadata for the frame is identified based on information included in the bitstream, and the metadata include position information indicating a position of the audio object, wherein the rendering section calculates vector base amplitude panning VBAP gains of two or three speakers placed around the position of the audio object, wherein each of the plurality of metadata is metadata for multiple samples in the frame of the audio signal.

2. The decoding apparatus according to claim 1, wherein each of the plurality of metadata is metadata for multiple samples arranged by dividing the number of the samples making up the frame by the number of the metadata.

3. A decoding method comprising the steps of:

acquiring a bitstream including encoded audio data obtained by encoding an audio signal of an audio object in a frame of a predetermined time segment and encoded data of a plurality of metadata for the frame;

decoding the encoded audio data;

decoding the encoded data of the plurality of metadata; and in response to determining that vector base amplitude panning (VBAP) gains of a plurality of samples in the frame of the audio signal of the audio object have been calculated, performing rendering based on the audio signal obtained by the decoding and on the metadata obtained by the decoding, and in response to determining that the VBAP gains of the plurality of samples in the frame of the audio signal of the audio object have not been calculated, return to calculation of the VBAP gains, wherein the number of the metadata for the frame is identified based on information included in the bitstream, wherein the method further comprises calculating VBAP gains of two or three speakers placed around the position of the audio object, wherein each of the plurality of metadata is metadata for multiple samples in the frame of the audio signal.

4. At least one non-transitory computer-readable storage medium encoded with executable instructions that, when executed by at least one processor, cause the at least one processor to perform a method comprising:

acquiring a bitstream including encoded audio data obtained by encoding an audio signal of an audio object in a frame of a predetermined time segment and encoded data of a plurality of metadata for the frame;

decoding the encoded audio data;

decoding the encoded data of the plurality of metadata; and in response to determining that vector base amplitude panning (VBAP) gains of a plurality of samples in the frame of the audio signal of the audio object have been calculated, performing rendering based on the audio signal obtained by the decoding and on the metadata obtained by the decoding, and in response to determining that the VBAP gains of the plurality of samples in the frame of the audio signal of the audio object have not been calculated, return to calculation of the VBAP gains, wherein the number of the metadata for the frame is identified based on information included in the bitstream, wherein the method further comprises calculating VBAP gains of two or three speakers placed around the position of the audio object, wherein each of the plurality of metadata is metadata for multiple samples in the frame of the audio signal.

* * * * *